US005915614A

United States Patent [19]

Davignon et al.

[11] Patent Number: 5,915,614

[45] Date of Patent: Jun. 29, 1999

[54] SELF-CONTAINED BUTTON ATTACHMENT ASSEMBLY

[75] Inventors: Paul A. Davignon, Uxbridge; Charles L. Deschenes, North Attleboro, both of Mass.

[73] Assignee: Avery Dennison Corporation, Pasadena, Calif.

[21] Appl. No.: 08/861,919

[22] Filed: May 22, 1997

Related U.S. Application Data

[63] Continuation of application No. 08/321,535, Oct. 11, 1994, abandoned, which is a continuation-in-part of application No. 07/989,201, Dec. 11, 1992, Pat. No. 5,383,260, application No. 08/185,679, Jan. 24, 1994, Pat. No. 5,518,162, application No. 08/305,486, Sep. 13, 1994, Pat. No. 5,588,575, and application No. 08/309,010, Sep. 19, 1994, Pat. No. 5,622,257.

[51] Int. Cl.[6] ..... A41H 37/10

[52] U.S. Cl. ..... 227/32; 227/67; 227/71; 112/110

[58] Field of Search ..... 227/31, 32, 34, 227/67, 68, 69, 70, 71, 72; 112/108, 110, 169, 475.14, 475.15; 223/102

[56] References Cited

U.S. PATENT DOCUMENTS

| | | | |
|---|---|---|---|
| 2,935,434 | 5/1960 | Dawson | 227/156 X |
| 3,440,984 | 4/1969 | Hofe | 112/110 |
| 3,470,834 | 10/1969 | Bone | 227/67 X |
| 3,709,174 | 1/1973 | Garry | 112/231 |
| 3,875,648 | 4/1975 | Bone | 227/71 X |
| 3,900,925 | 8/1975 | La Torraca | 24/90 |
| 4,128,067 | 12/1978 | Zocher | 112/222 |
| 4,161,148 | 7/1979 | Bakhalov et al. | 112/110 |
| 4,229,930 | 10/1980 | Ostermaier | 54/79 |
| 4,281,782 | 8/1981 | Marsh et al. | 227/68 X |
| 4,296,698 | 10/1981 | Davidson et al. | 227/68 X |
| 4,316,562 | 2/1982 | Davidson et al. | 227/68 X |
| 4,361,101 | 11/1982 | Marsh et al. | 227/68 X |
| 4,436,041 | 3/1984 | Taddicken | 112/110 |
| 4,485,748 | 12/1984 | Albrecht et al. | 112/110 |
| 5,020,458 | 6/1991 | Michelberger | 112/7 |
| 5,020,713 | 6/1991 | Kunreuther | 227/67 |
| 5,046,437 | 9/1991 | Hiratsuka et al. | 112/110 |
| 5,205,458 | 4/1993 | Kunreuther | 227/71 |

*Primary Examiner*—Clark F. Dexter
*Attorney, Agent, or Firm*—Kriegsman & Kriegsman

[57] ABSTRACT

A self-contained button attachment assembly. In a preferred embodiment, the assembly comprises a fastener dispensing tool. The tool includes a hollow, open-ended, unitary housing having a top portion and a bottom portion. The top portion and the bottom portion are generally cylindrical in shape, the top portion having a substantially greater cross-sectional diameter than the bottom portion. Four hollow, slotted needles are fixedly mounted in the housing and extend out through the bottom thereof. Four ejector rods are slidably mounted within the four needles, the four ejector rods being fixedly mounted at their respective top ends on a plate that is slidably mounted within the top portion of the housing and is accessible through the open top end thereof. The assembly also comprises a conventional garment button of the type having four transverse openings. The button is positioned within the bottom portion of the housing so that the four needles extend partially through its four transverse openings, the button being releasably retained within the housing by a circumferential lip formed on the inside of the housing. The assembly further comprises a pair of fasteners, each fastener comprising a U-shaped flexible filament and a pair of transverse feet, the transverse feet being disposed at opposite ends of the filament and extending perpendicularly to the plane of the filament. Each transverse foot is loaded into one of the hollow slotted needles and is positioned over the button.

11 Claims, 8 Drawing Sheets

SELF-CONTAINED BUTTON ATTACHMENT ASSEMBLY

CROSS-REFERENCES TO RELATED APPLICATIONS

This application is a continuation of application Ser. No. 08/321,535 filed on Oct. 11, 1994, now abandoned, which in turn is a continuation-in-part of each of the following: U.S. Ser. No. 07/989,201 filed Dec. 11, 1992, now U.S. Pat. No. 5,383,260; U.S. Ser. No. 08/185,679, filed Jan. 24, 1994, now U.S. Pat. No. 5,518,162; U.S. Ser. No. 08/305,486, filed Sep. 13, 1994; now U.S. Pat. No. 5,588,575; and U.S. Ser. No. 08/309,010 filed Sep. 19, 1994, now U.S. Pat. No. 5,622,257.

BACKGROUND OF THE INVENTION

The present invention relates generally to the attachment of buttons to garments and like materials using fasteners.

The conventional method of attaching buttons to garments or fabrics, either by machine or by hand, is with thread. The button is held in place and a needle equipped with thread is inserted through each of two, three or more holes in the button and into the material several times until sufficient strands of thread exist to securely hold the button to the material. The thread must then be tied or otherwise fastened so that it will not unravel. In some instances, where it is desired to elevate the button from the material, a pedestal effect is achieved by laterally wrapping the strands with additional thread. The disadvantages of securing buttons to fabric or garments by this method are several. First of all, it is a slow and tedious job and the button can soon become detached if only one of the threads is severed or if the ends of the thread are not secured properly.

In the commonly assigned U.S. Pat. Nos. 3,399,432, 3,470,834, and 3,494,004, all of which are incorporated herein by reference, there is described a plastic fastener which may be used instead of thread to attach a button to an article of clothing. The fastener typically comprises a flexible filament having a head at one end and a transverse bar at the opposite end. A plurality of such fasteners are typically manufactured as part of a clip in which the fasteners are interconnected in a row to a stringer or runner bar connected to the transverse bars of the fasteners by corresponding necks or connector posts. To sever an individual fastener from the fastener clip and to attach the severed fastener to a desired article (e.g., through a button hole and into an article of clothing), a fastener dispensing device is typically used. Such a device typically comprises a casing, a needle projecting from the casing, the needle and the casing having longitudinal bores in alignment with each other, a plunger slidable back and forth within said bores, a handle telescoping over the rear of the casing for sliding said plunger within said bores, and means for feeding fasteners into the device successively with the transverse bars in alignment with said bores ahead of the plunger so that they may be projected through the needle by reciprocating the plunger. Typically, the rear end of the needle is shaped to define a knife edge so that insertion of the transverse bar into the longitudinal bore of the needle using the plunger causes the knife edge of the needle to sever the connector post connecting the fastener to the remainder of the fastener clip.

While the above-described fasteners have been found to be generally satisfactory for attaching buttons to certain articles of clothing, they have not found universal application for the following reasons: First, when placed in direct contact with a person's skin, the transverse bar of the fastener has a tendency to be irritating. This is in part because the above-described severing of the connector post often leaves a burr on the bottom of the transverse bar and is in part because of the somewhat sharp ends and large size of the transverse bar. Second, the fasteners are often too big to be used with many buttons and, therefore, require the use of specially designed buttons having large holes. Third, the fasteners tend to be conspicuous in appearance due to the fact that a separate fastener is used for every button hole, as opposed to being looped between two or more button holes in the same way that thread typically is.

In commonly-assigned PCT Application No. PCT/US93/12112, which was published Jun. 23, 1994, and which is incorporated herein by reference, there is disclosed a fastener dispensing tool and fastener clip for use therewith. The fastener clip includes a plurality of fasteners which may be used, for example, in attaching a button to a garment or a piece of fabric, each fastener comprising a filament having a foot at one end. The fastener clip also comprises at least one runner bar, each fastener being connected to the runner bar by a severable connector post. The fastener dispensing tool includes a pair of needles. Each needle has a knife edge formed on its side which is adapted to sever a connector post from its associated runner bar. The tool also includes an ejector mechanism which is slidably mounted back and forth within the body of the tool and is rearwardly biased by a spring. The ejector mechanism is manually operable from the rear of the body of the fastener dispensing tool and includes a pair of ejector rods which are slidable back and forth within the bores of the needles.

To attach a button to a garment or like material using a fastener dispensing tool of the type described above, a user typically follows the following sequence of steps: (1) the user manually feeds a fastener clip into the fastener dispensing tool until a desired fastener is in position to be dispensed by the fastener dispensing tool; (2) the user inserts the needle(s) of the fastener dispensing tool first through a loose button and then through the desired garment; and (3) the user dispenses an individual fastener from the fastener clip through the button and the garment using the fastener dispensing tool. The fastener clip may then be advanced within the fastener dispensing tool so that additional fasteners may be dispensed therefrom into the same or different buttons. As can readily be appreciated, the above-described sequence of steps, particularly the loading of the fastener clip into the fastener dispensing tool and the insertion of the needles of the fastener dispensing tool through both the button to be attached and the garment or like material, may be difficult for some users in certain situations.

Other patents of interest include U.S. Pat. No. 4,361,101, inventors Marsh et al., which issued Nov. 30, 1982; U.S. Pat. No. 4,316,562, inventors Davidson et al., which issued Feb. 23, 1982; U.S. Pat. No. 4,296,698, inventors Davidson et al., which issued Oct. 27, 1981; U.S. Pat. No. 4,281,782, inventors Marsh et al., which issued Aug. 4, 1981; U.S. Pat. No. 3,900,925, inventor La Torraca, which issued Aug. 26, 1975; and U.S. Pat. No. 2,935,434, inventor Dawson, which issued May 3, 1960.

SUMMARY OF THE INVENTION

It is an object of the present invention to overcome at least some of the problems associated with the above-described techniques for attaching buttons to garments and like materials.

In furtherance of these and other objects to be described or to become apparent below, a self-contained button attachment assembly constructed in accordance with the teachings of the present invention comprises in a first preferred embodiment a fastener dispensing tool. The fastener dispensing tool includes a hollow, open-ended, unitary housing having a top portion and a bottom portion. The top portion and the bottom portion are generally cylindrical in shape, the top portion having a substantially greater cross-sectional diameter than the bottom portion. Four hollow, slotted needles are fixedly mounted in the bottom portion of said housing and extend out through the bottom of said housing. Four ejector rods are slidably mounted within said four hollow slotted needles, the four ejector rods being fixedly mounted at their respective top ends on a plate that is slidably mounted within the top portion of the housing and is accessible through the open top end thereof.

The assembly also comprises a conventional garment button of the type having four transverse openings. The button is positioned within the bottom portion of the housing so that the four needles extend partially through its four transverse openings, the button being releasably retained within the housing by a circumferential lip integrally formed on the inside thereof.

The assembly further comprises a pair of fasteners, each fastener comprising a U-shaped flexible filament and a pair of transverse feet, the transverse feet being disposed at opposite ends of the U-shaped flexible filament and extending perpendicularly to the plane of the filament. Each transverse foot is loaded into one of the hollow slotted needles and is positioned over the button so that, upon insertion of the needles into a desired garment and upon actuation of the tool, the transverse feet are pushed by the ejector rods through the openings in the button, through the garment, and out of the needles, thereby securing the button to the garment.

In a second preferred embodiment, the self-contained button attachment assembly is generally the same as that of the first preferred embodiment, except that the fastener dispensing tool of the second preferred embodiment comprises a different type of housing than that of the first preferred embodiment, the housing of the second preferred embodiment comprising a top portion and a bottom portion which are interconnected in a telescoping fashion so that the top portion is slidably movable relative to the bottom portion. In addition, the top end of the top portion of the housing is closed, and the ejector rods are fixedly mounted directly on said closed top end so that movement of the top portion towards the bottom portion causes the ejector rods to be moved down through the needles.

According to a third preferred embodiment, the self-contained button attachment assembly comprises a fastener dispensing tool which comprises a hollow, cylindrical, open-ended, unitary housing. A circumferential lip is integrally formed on the inside of the housing near the open bottom end thereof to releasably secure within the housing a conventional garment button of the type having four transverse openings. Four needles are fixedly mounted on a pusher plate slidably mounted within the housing and accessible from the open top end thereof. The needles extend downwardly through the four transverse openings of the button, each of said needles being a solid elongated member terminating in a tip adapted to penetrate a desired article of commerce and having a chamber adapted to receive a transverse foot of a fastener, the chamber being located over the button. The chamber is shaped in such a way as to prevent the transverse foot from being pulled therefrom when low tension is applied to the flexible filament (i.e., prior to the complete insertion of the transverse foot through a garment or like material), but yet, so as to cause the transverse bar to be pulled out of the chamber when high tension is applied to the flexible filament (i.e., following the complete insertion of the transverse bar through the garment or like material). The assembly further includes a pair of U-shaped fasteners of the type described above, one transverse foot of each fastener being loaded into the chamber of a different needle.

As can readily be appreciated, one particularly advantageous aspect of the above-described self-contained button attachment assembly is that it can easily be operated by a user since it does not require the user to load a fastener into the tool and/or to align a button with the tool.

Also, after the dispensing of the button and fasteners from the fastener dispensing tool, the fastener dispensing tool may be disposed of.

The present invention is also directed to the above-described fastener dispensing tool.

Additional objects, as well as features and advantages of the present invention, will be set forth in part in the description which follows, and in part will be obvious from the description or may be learned by practice of the invention. These embodiments will be described in sufficient detail to enable those skilled in the art to practice the invention, and it is to be understood that other embodiments may be utilized and that changes may be made without departing from the scope of the invention. The following detailed description is, therefore, not to be taken in a limiting sense, and the scope of the present invention is best defined by the appended claims.

BRIEF DESCRIPTION OF THE DRAWINGS

The accompanying drawings, which are hereby incorporated into and constitute a part of this specification, illustrate various embodiments of the invention and, together with the description, serve to explain the principles of the invention. In the drawings wherein like reference numerals represent like parts.

DETAILED DESCRIPTION OF PREFERRED EMBODIMENTS

Figure 1:
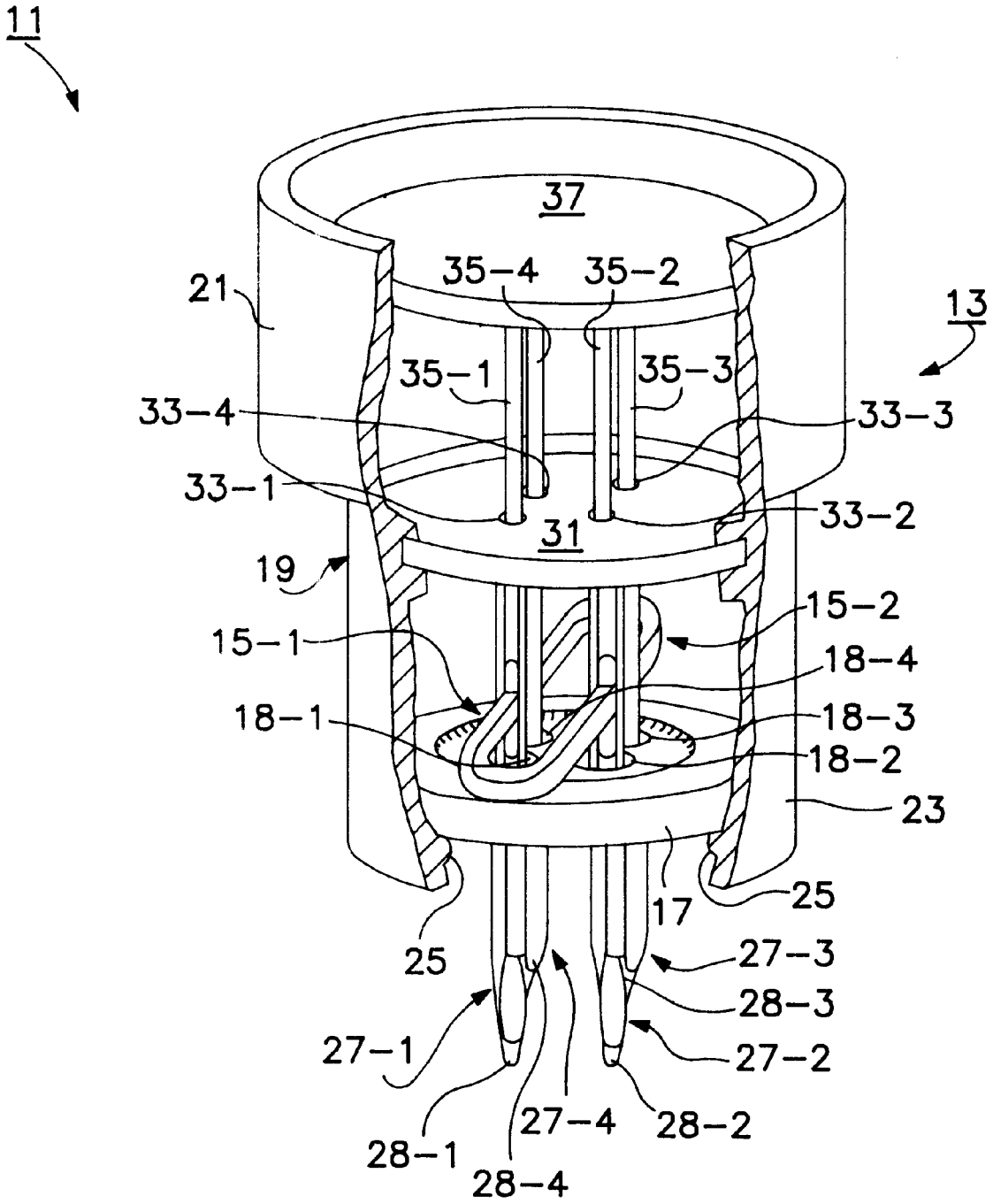
FIG. 1 is a front perspective view, broken away in part, of a first embodiment of a self-contained button attachment assembly constructed according to the teachings of the present invention.
Figure 2:
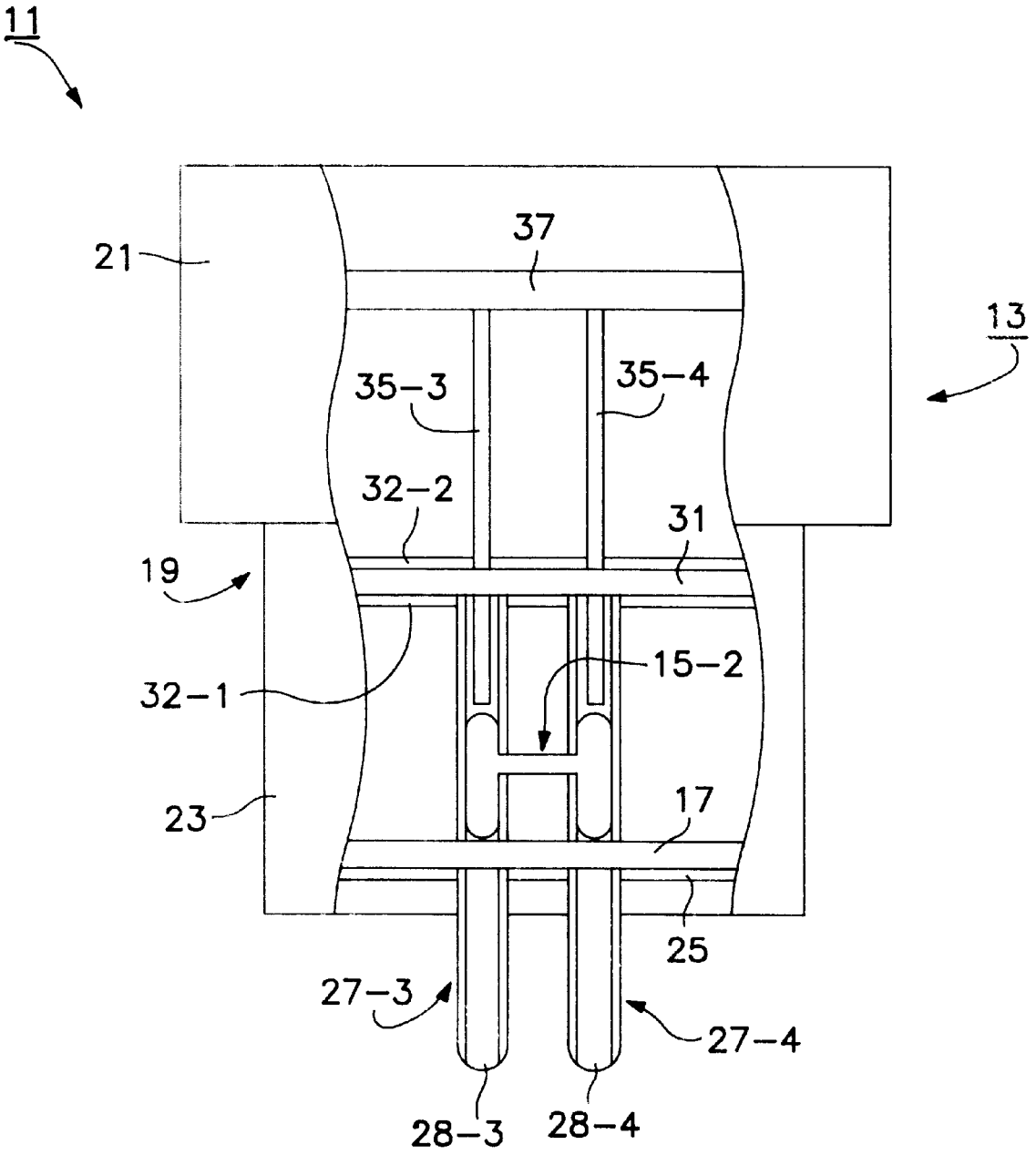
FIG. 2 is a rear view of the self-contained button attachment assembly of FIG. 1.
Figure 3:
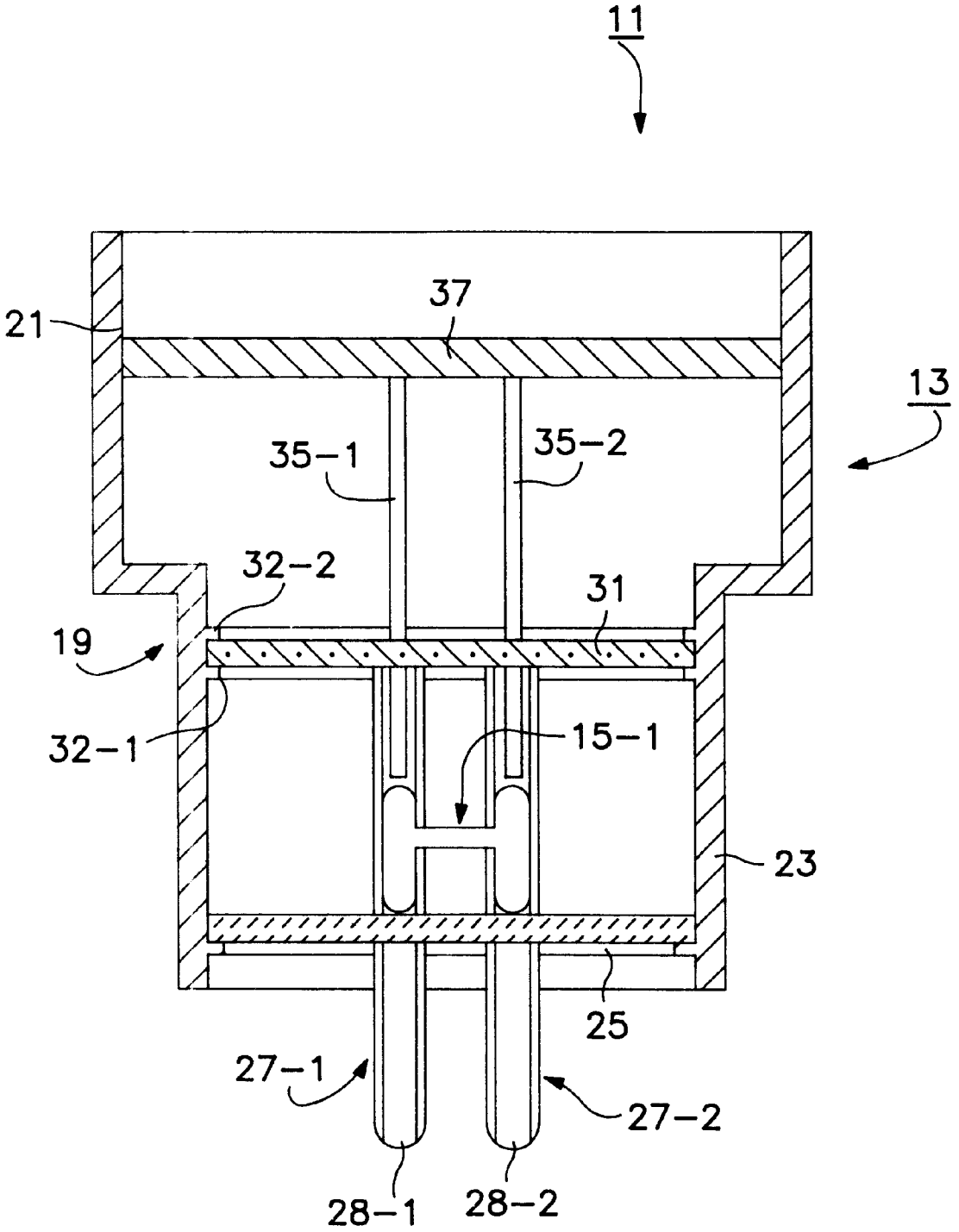
FIG. 3 is a section view of the self-contained button attachment assembly of FIG. 1.
Figure 4:
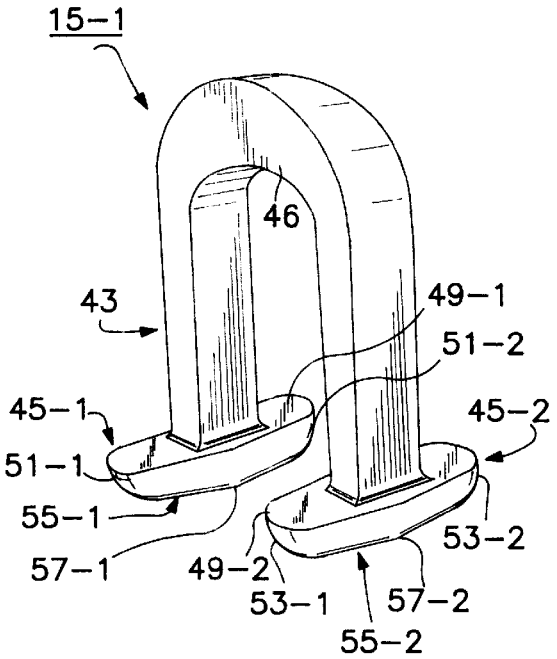
FIG. 4 is an enlarged front perspective view of one of the fasteners shown in FIG. 1.
Figure 5:
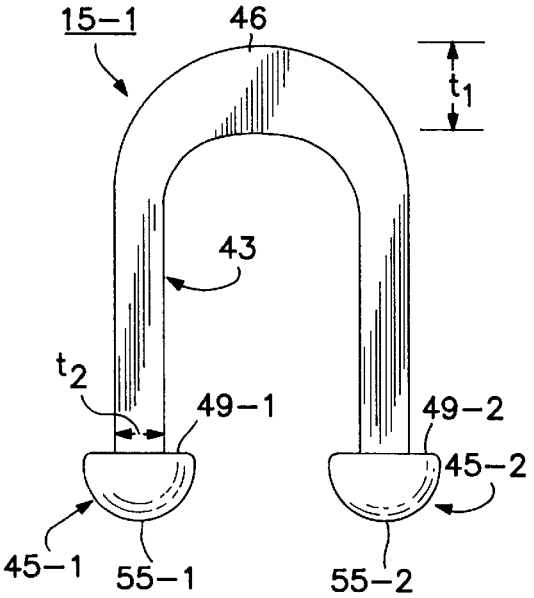
FIG. 5 is a front view of the fastener shown in FIG. 1, the rear view being a mirror image thereof.
Figure 6:
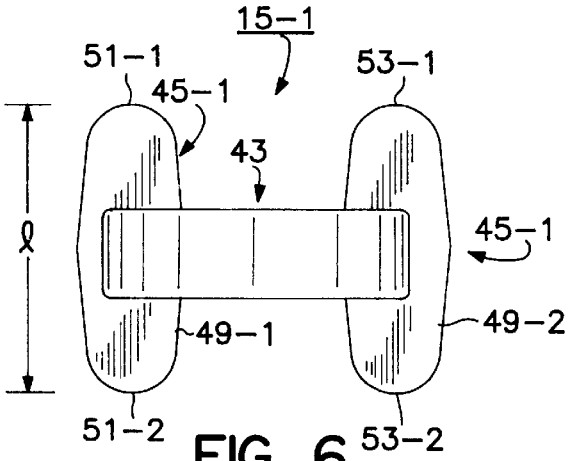
FIG. 6 is a top view of the fastener shown in FIG. 1.
Figure 8:
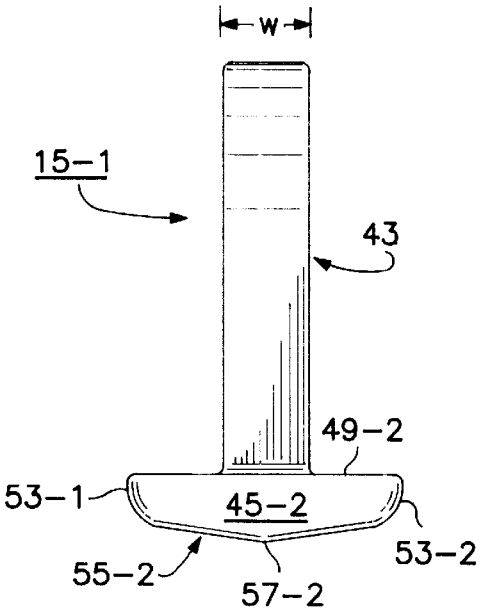
FIG. 8 is a right side view of the fastener shown in FIG. 1, the left side being a mirror image thereof.
Figure 7:
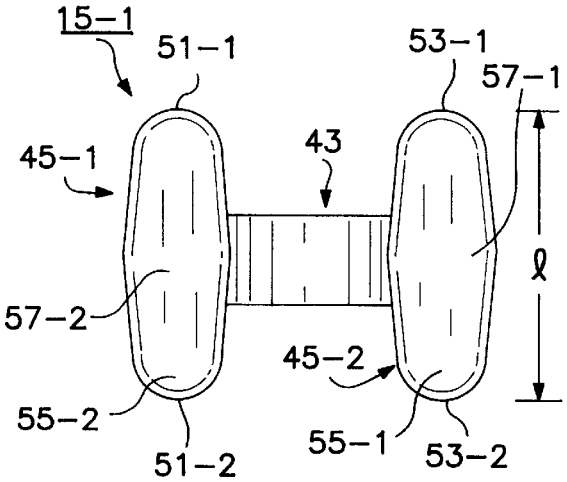
FIG. 7 is a bottom view of the fastener shown in FIG. 1.

Referring now to FIGS. 1 through 3, there are shown various views of a first embodiment of a self-contained button attachment assembly constructed according to the teachings of the present invention, the self-contained button attachment assembly being represented generally by reference numeral 11.

Assembly 11 comprises a fastener dispensing tool 13, a pair of identical fasteners 15-1 and 15-2 and a conventional garment button 17.

Fastener dispensing tool 13 comprises a unitary housing 19. Housing 19, which is preferably made from a durable, lightweight, molded plastic or similar material, is shaped to define an elongated, hollow, open-ended member having a top portion 21 and a bottom portion 23. Top portion 21 and bottom portion 23 are cylindrical in shape and are arranged coaxially, with top portion 21 having a substantially greater cross-sectional diameter than bottom portion 23 for reasons to become apparent below. A circumferential lip 25 is integrally formed on the interior surface of bottom portion 23 for use in releasably securing button 17 within housing 19.

Fastener dispensing tool 13 also comprises a plurality of identical needles 27-1 through 27-4. Needles 27-1 through 27-4 may consist of the shank or stem portions of conventional hollow slotted needles of the type shown and described, for example, in U.S. Pat. No. 5,305,939, which is incorporated herein by reference. Needles 27-1 through 27-4 are aligned with and are partially inserted through the openings 18-1 through 18-4, respectively, of button 17. The bottom ends of needles 27-1 through 27-4 are shaped to define tips 28-1 through 28-4, respectively, adapted for insertion through a desired garment or like material. The top ends of needles 27-1 through 27-4 are fixedly mounted on a needle carrier 31. Needle carrier 31, in turn, is fixedly mounted within housing 19 between a pair of integrally formed, circumferentially extending lips 32-1 and 32-2. (Provided that needle carrier 31 is made from a suitable material, needle carrier 31 may additionally or alternatively be secured to housing 19 by heat-sealing.) A plurality of small transverse holes 33-1 through 33-4 are formed in carrier 31, holes 33-1 through 334 being coaxially aligned with the longitudinal bores of needles 27-1 through 27-4, respectively.

Fastener dispensing tool 13 additionally includes a plurality of ejector rods 35-1 through 35-4. Ejector rods 35-1 through 35-4, which, as will be seen below, are used to eject fasteners 15-1 and 15-2 from needles 27-1 through 27-4, are inserted through holes 33-1 through 334, respectively, of carrier 31 and into the longitudinal bores of needles 27-1 through 27-4, respectively. The top ends of ejector rods 35-1 through 35-4 are fixedly mounted on a pusher plate 37 so that ejector rods 35-1 through 35-4 may be moved downwardly through needles 27-1 through 27-4 by having a user press down on pusher plate 37 with the user's thumb or finger. In order to prevent undesired upwards or downwards movement of ejector rods 35-1 through 35-4 relative to needles 27-1 through 27-4, the relative diameters of ejector rods 35-1 through 35-4 and holes 33-1 through 33-4 may be chosen to precipitate an appropriate frictional engagement therebetween. Alternatively or additionally, the relative diameters of pusher plate 37 and top portion 21 may be suitably chosen for an appropriate frictional response.

Referring now to FIGS. 4 through 8, fastener 15-1 is shown in greater detail (fastener 15-2 being identical to fastener 15-1). Fastener 15-1 includes a flexible U-shaped filament 43 and a pair of transverse bars or feet 45-1 and 45-2 disposed at opposite ends thereof. In order to maximize the strength of fastener 15-1, U-shaped flexible filament 43 is generally rectangular in cross-section, filament 43 having a width w that is substantially uniform over its length and having a non-uniform thickness, i.e., arcuate region 46 has a thickness $t_1$ greater than the thickness $t_2$ near feet 45-1 and 45-2.

Feet 45-1 and 45-2, which extend parallel to one another and perpendicularly to the plane of filament 43, are appropriately dimensioned so that they may be inserted into a desired garment through a pair of button holes of conventional size and thereafter be retained by the underside of the garment. In order that fastener 15-1 may be used with garments in which feet 45-1 and 45-2 are placed in direct contact with a person's skin, feet 45-1 and 45-2 include the following features which are designed to minimize contact with and irritation of a person's skin. First, feet 45-1 and 45-2 have a length/which is comparatively small, i.e., approximately 2 mm as compared to 6 mm for the transverse bars of existing like fasteners, and an overall size which is comparable to that of a knot of thread. Consequently, feet 45-1 and 45-2 have relatively little surface area which may come into contact with a person's skin. Second, the top surfaces 49-1 and 49-2 of feet 45-1 and 45-2, respectively, are generally flat. This gives feet 45-1 and 45-2 a low profile and inhibits the rotational movement of feet 45-1 and 45-2 relative to the underside of a garment to which fastener 15-1 has been attached. Third, feet 45-1 and 45-2 have rounded ends 51-1/51-2 and 53-1/53-2, respectively, as compared to the straight, square ends of conventional transverse bars. Fourth, the bottom surfaces 55-1 and 55-2, respectively, of feet 45-1 and 45-2 are contoured for minimal irritation of a person's skin by extending downwardly furthest and having the greatest cross-sectional diameter at their respective midpoints 57-1 and 57-2 and by sloping upwardly and diminishing in cross-sectional diameter on opposite sides of midpoints 57-1 and 57-2.

Referring back to FIGS. 1 through 3, feet 45-1 and 45-2 of fastener 15-1 can be seen to be loaded into needles 27-1 and 27-2, respectively, and are positioned above button 17. Similarly, feet 45-1 and 45-2 of fastener 15-2 are loaded into needles 27-3 and 274, respectively, and are also positioned above button 17.

To operate self-contained button attachment assembly 11, the user merely inserts needles 27-1 through 274 through a desired garment or like material and fully depresses pusher plate 37. By so doing, ejector rods 35-1 through 35-4 are forced downwardly through needles 27-1 through 27-4, respectively, causing the respective feet 45-1 and 45-2 of fasteners 15-1 and 15-2 to be pushed first through openings 18-1 through 18-4 of button 17 and then through the desired garment or like material. With fasteners 15-1 and 15-2 thus secured to the desired garment or like material, tool 13 is then pulled away therefrom. Because of its engagement by the U-shaped filament portion 43 of each fastener 15, button 17 is secured to the garment and is pulled out of tool 13 when tool 13 is moved away from the garment.

Figure 9:
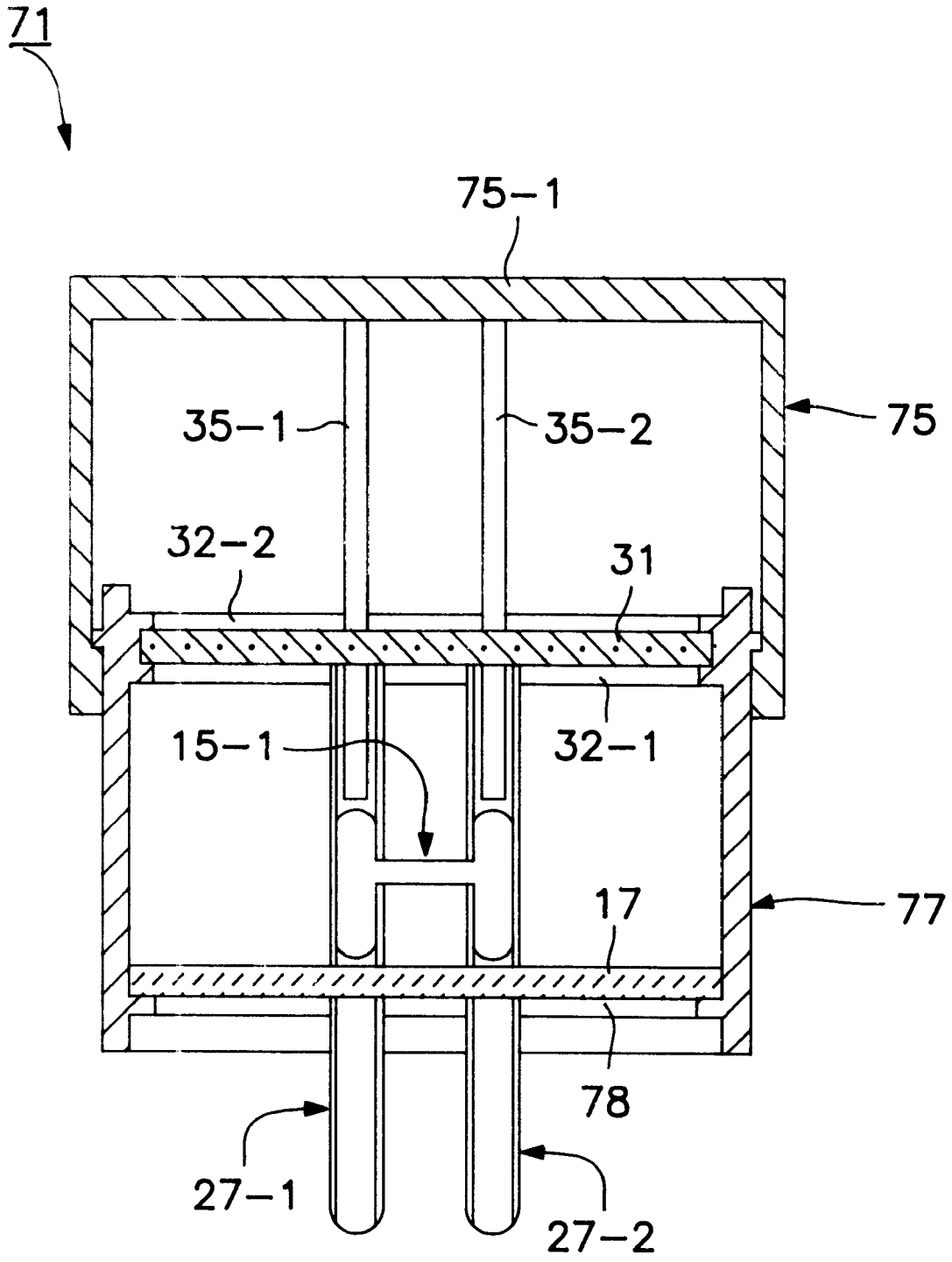
FIG. 9 is a section view of a second embodiment of a self-contained button attachment assembly constructed according to the teachings of the present invention.

Referring now to FIG. 9, there is shown a section view of a second embodiment of a self-contained button attachment assembly constructed according to the teachings of the present invention, the self-contained button attachment assembly being represented generally by reference numeral 71.

Assembly 71 is similar in most respects to assembly 11, the primary differences between assembly 71 and assembly 11 residing in the construction of the housing of assembly 71 and in the absense of a pusher plate 37 in assembly 71. The housing of assembly 71 is a two-piece construction, comprising a top member 75 and a bottom member 77, top member 75 being telescopingly mounted on top of bottom member 77. Top member 75 is sized and shaped in essentially the same manner as top portion 21 of housing 19, the primary difference being that top member 75 has a closed top end 75-1 to which ejector rods 35-1 through 35-4 (ejector rods 35-3 and 35-4 not being visible in FIG. 9) are fixedly mounted. Bottom member 77 is sized and shaped essentially the same manner as bottom portion 23 of housing 19, bottom member 77 having an integrally-formed, circumferential lip 78, upon which button 17 is removably seated, and a pair of integrally-formed, circumferential lips 32-1 and 32-2, between which needle carrier 31 is fixedly mounted. As in tool 13, four hollow slotted needles 27-1 through 27-4 (needles 27-3 and 27-4 not being visible in FIG. 9) are fixedly mounted on needle carrier 31 and extend downwardly through button 17.

Assembly 71 is operated in essentially the same manner as assembly 71, ejector rods 35-1 through 35-4 being actuated by pushing down on top member 75.

Figure 10:
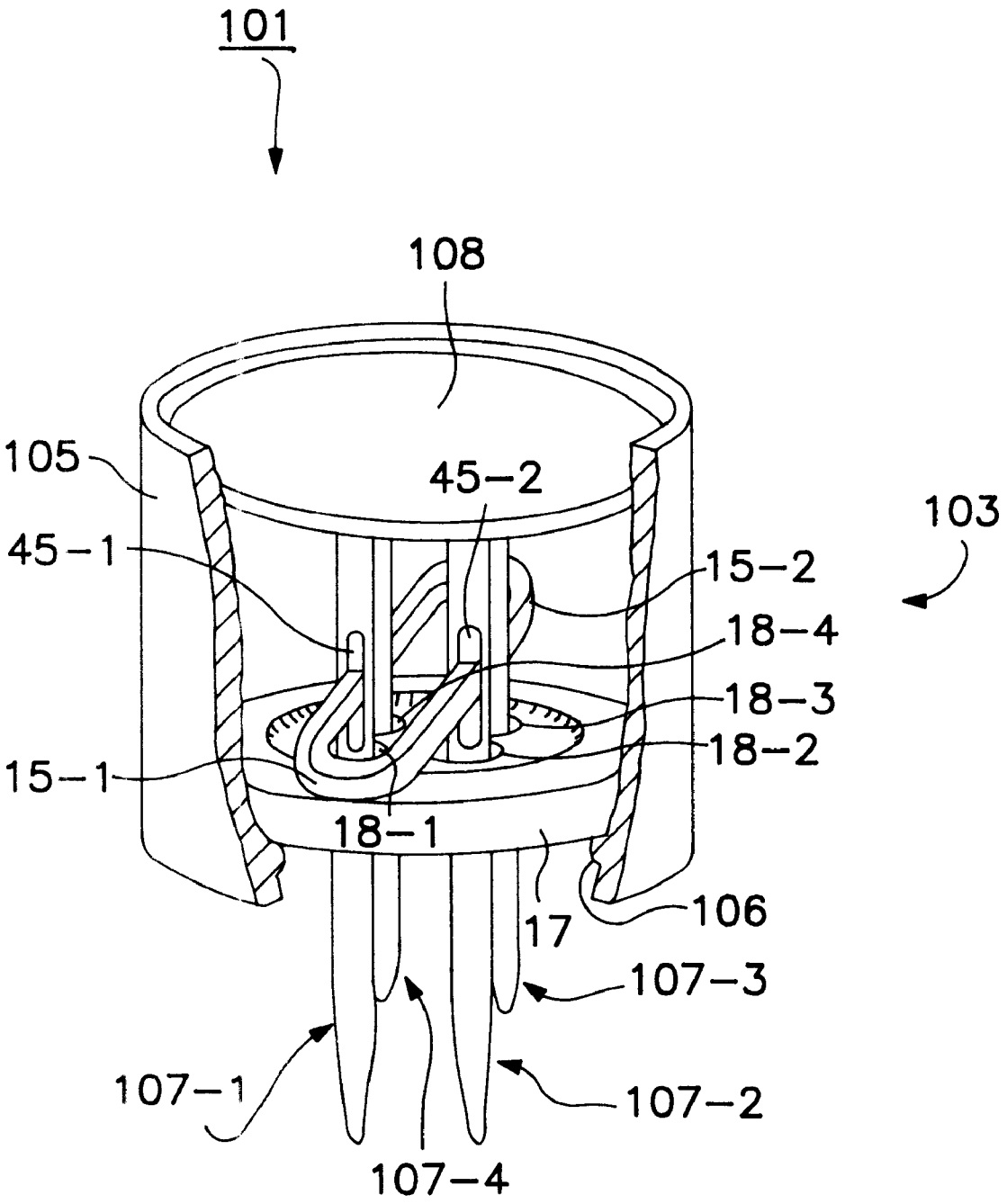
FIG. 10 is a front perspective view, broken away in part, of a third embodiment of a self-contained button attachment assembly constructed according to the teachings of the present invention.
Figure 11:
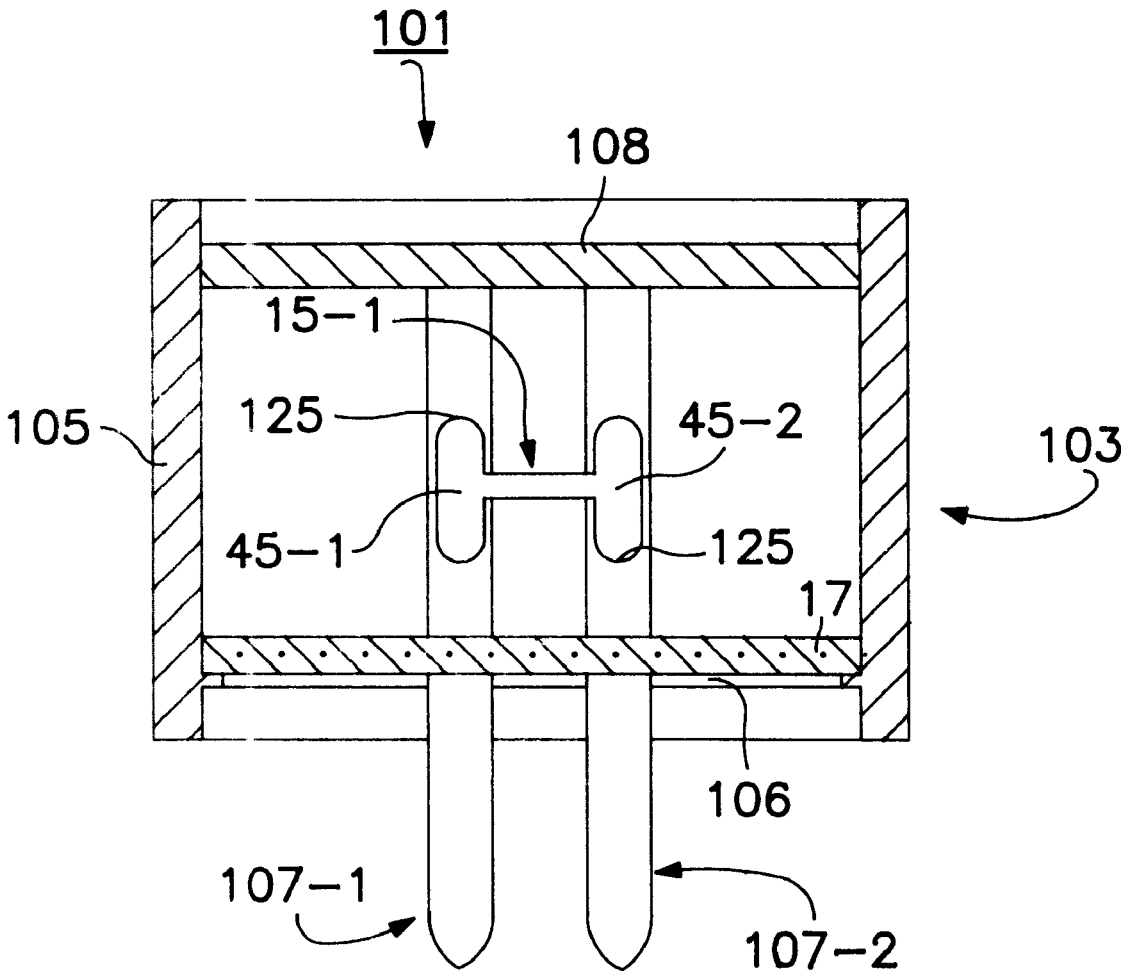
FIG. 11 is a section view taken from the front of the self-contained button attachment assembly of FIG. 10.

Referring now to FIGS. 10 and 11, there is shown a front perspective view and a section view, taken from the rear, of a third embodiment of a self-contained button attachment assembly constructed according to the teachings of the present invention, the self-contained button attachment assembly being represented generally by reference numeral 101.

Assembly 101 comprises a fastener dispensing tool 103, a pair of fasteners 15-1 and 15-2 and a conventional garment button 17.

Fastener dispensing tool 103 comprises a hollow, cylindrical, open-ended, unitary housing 105. Housing 105 is similar in most respects to bottom member 77 of assembly 71, the primary difference between housing 105 and bottom member 77 being that housing 105 does not have lips 32-1 and 32-2.

Like bottom member 77, housing 105 has an integrally-formed, circumferential lip 106, upon which button 17 is removably seated.

Fastener dispensing tool 103 also comprises a plurality of needles 107-1 through 107-4, which are fixedly mounted on a pusher plate 108 slidably mounted within housing 103 much in the same manner as pusher plate 37 is slidably mounted within top section 21 of housing 13. Needles 107-1 through 107-4 are partially inserted through corresponding openings 18-1 through 18-4 in button 17. Each needle 107 is loaded with a foot 45 of a fastener 15 as described below.

Figure 12:
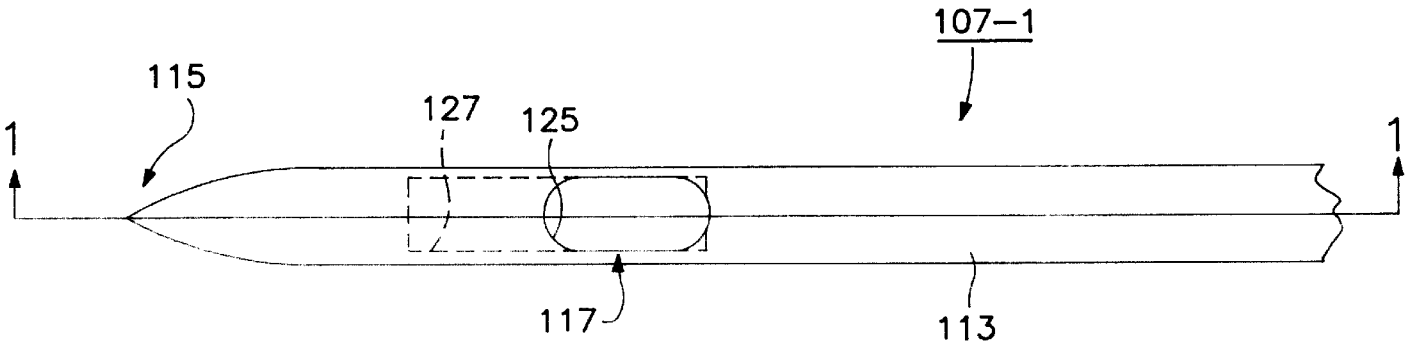
FIG. 12 is a fragmentary top view of one of the needles shown in FIG. 10.
Figure 13:
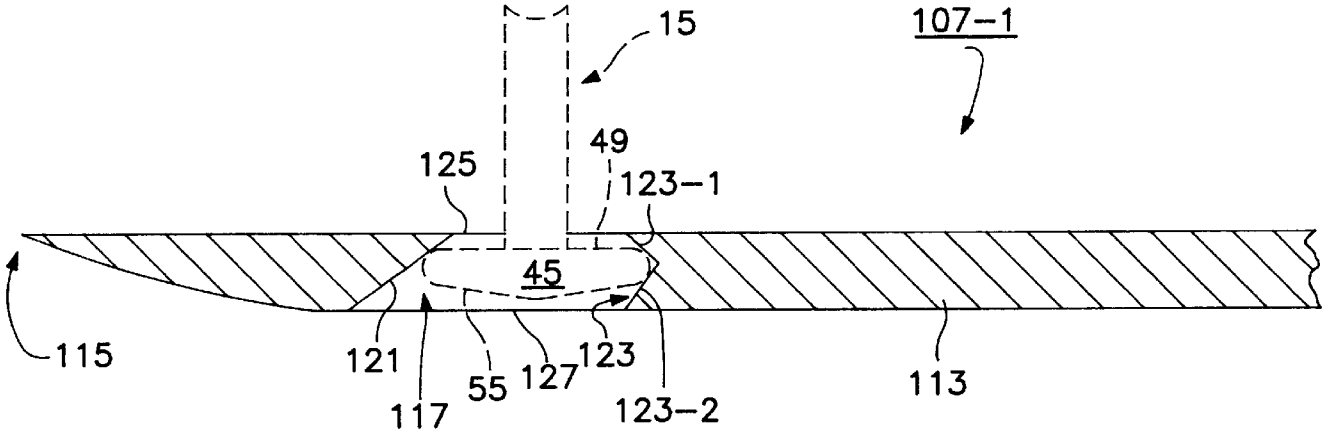
FIG. 13 is a fragmentary section view of the needle taken along line 1—1 in FIG. 12, the needle being shown loaded, in phantom, with a transverse foot of a plastic fastener.

Referring now to FIGS. 12 and 13, needle 107-1 is shown in greater detail (needles 107-2 through 107-4 being identical to needle 107-1). Needle 107-1, which preferably has a construction similar to that disclosed in presently pending U.S. patent application Ser. No. 08/305,486, filed Sep. 13, 1994, comprises an elongated member or shank 113, which is preferably a solid, unitary element which may be made, for example, of plastic or metal and may be formed by various techniques, such as molding, electroforming and stamping. Shank 113 is shaped to terminate at its front end in a relatively sharp, closed-ended tip 115 (as contrasted with the open, spoon-shaped tips of conventional needles) and is shaped to include a chamber 117 spaced rearwardly from tip 115 so that chamber 117 is situated above openings 18-1 through 184 of button 17.

Chamber 117, which is adapted to receive and retain, under the conditions specified below, a foot 45 of a fastener 15, is defined by a front end 121, a rear end 123, an open top 125 and an open bottom 127. Open top 125, which is spaced rearwardly a distance from tip 115, is appropriately sized and shaped to permit the insertion and removal of foot 45 into and out of chamber 117. Front end 121 is shaped to releasably engage the top surface 49 of the front of foot 45, and rear end 123 is shaped to releasably engage both the top surface 49 and the bottom surface 55 of the rear of foot 45 in such a way as to prevent foot 45 from being pulled out of chamber 117 through open top 125 when low tension is applied to flexible filament 43 of fastener 15 (i.e., prior to the complete insertion of foot 45 through the garment of like material), but yet, so as to cause foot 45 to be pulled out of chamber 117 through open top 125 when high tension is applied to flexible filament 43 (i.e., following the complete insertion of foot 45 through the garment). As seen best in FIG. 12, front end 121 angles downwardly towards tip 115 (for engaging the front of top surface 49), and rear end 123 includes a top wall 123-1 angled down away from tip 115 (for engaging the rear of top surface 49) and a bottom wall 123-2 angled down towards tip 115 (for engaging the rear of bottom surface 55).

To operate assembly 101, the user merely inserts needles 107-1 through 107-4 through a desired garment (by pushing downwardly on plate 108) until chambers 117-1 through 117-4 are positioned on the opposite side of the garment. This will cause feet 45 of fasteners 15-1 and 15-2 to be discharged from chambers 117-1 through 117-4, thereby securing fasteners 15-1 and 15-2 to the garment. With fasteners 15-1 and 15-2 thus secured to the garment, tool 103 is then pulled away therefrom. Because of its engagement by the U-shaped filament portion 43 of each fastener 15, button 17 is secured to the garment and is pulled out of tool 103 when tool 103 is moved away from the garment.

It is to be understood that, whereas, in the preferred embodiments shown and described herein, button 17 has four transverse openings 18-1 through 18-4, the number of such openings need not be four and could, in fact, be any number other than four, the other components of the self-contained button attachment assembly being modified accordingly. For example, if button 17 were to have only two transverse openings, one could easily modify any of asseblies 11, 71 and 101 by simply eliminating one of the fasteners and two of the needles. Other modifications of this nature will be readily apparent to one of ordinary skill in the art.

The embodiments of the present invention recited herein are intended to be merely exemplary and those skilled in the art will be able to make numerous variations and modifications to it without departing from the spirit of the present invention. All such variations and modifications are intended to be within the scope of the present invention as defined by the claims appended hereto.

What is claimed is:

1. A self-contained button attachment assembly comprising:

(a) a fastener dispensing tool, said fastener dispensing tool comprising a housing, a first needle and a second needle, said first needle being mounted in and extending from said housing and having a tip at its bottom end, said second needle being mounted in and extending from said housing and having a tip at its bottom ends;

(b) a button, said button being releasably secured within said housing and having a first opening through which said first needle extends and a second opening through which said second needle extends; and (c) a first plastic fastener, said first plastic fastener being positioned within said housing over said button, said first plastic fastener comprising a flexible filament having a first end and a second end, a first transverse foot disposed at said first end and a second transverse foot disposed at said second end, said first transverse foot being loaded into said first needle in order to be dispensed through said first opening in said button using said fastener dispensing tool, said second transverse foot being loaded into said second needle in order to be dispensed through said second opening in said button using said fastener dispensing tool.

2. The self-contained button attachment assembly as claimed in claim 1 wherein said flexible filament of said first plastic fastener has a bent shape, said first and second transverse feet being parallel to one another and perpendicular to said flexible filament.

3. The self-contained button attachment assembly as claimed in claim 2 wherein said flexible filament of said first plastic fastener is U-shaped.

4. The self-contained button attachment assembly as claimed in claim 1 wherein said flexible filament, said first transverse foot and said second transverse foot are integrally formed as a molded plastic structure.

5. The self-contained button attachment assembly as claimed in claim 1 wherein said flexible filament is generally rectangular in cross-section, has a substantially uniform width over its length and has a non-uniform thickness.

6. The self-contained button attachment assembly as claimed in claim 5 wherein said flexible filament has a midpoint and wherein said said not-uniform thickness of said flexible filament is thinner near said transverse feet than near said midpoint.

7. The self-contained button attachment assembly as claimed in claim 1 wherein each of said transverse feet has a flat top surface, a bottom surface, and a longitudinal axis bounded by a rounded front end and a rounded rear end, said bottom surface having a midpoint between said rounded front and rear ends, said bottom surface extending downwardly such that said midpoint is furthest from said top surface and sloping upwardly on opposite sides of said midpoint towards said rounded front and rear ends, each of said transverse feet having a cross-section that is greatest at said midpoint and that diminishes on opposite sides thereof towards said rounded front and rear ends.

8. The self-contained button attachment assembly as claimed in claim 1 wherein said fastener dispensing tool further comprises a third needle and a fourth needle, each of said third and fourth needles being mounted in and extending from said housing and having a tip at its bottom end, wherein said button has a third opening through which said third needle extends and a fourth opening through which said fourth needle extends, and further comprising a second plastic fastener, said second plastic fastener comprising a flexible filament having a first end and a second end, a first transverse foot disposed at said first end and a second transverse foot disposed at said second end, said first transverse foot of said second plastic fastener being loaded into said third needle in order to be dispensed through said third opening in said button using said fastener dispensing tool, said second transverse foot of said second plastic fastener being loaded into said fourth needle in order to be dispensed through said fourth opening in said button using said fastener dispensing tool.

9. The self-contained button attachment assembly as claimed in claim 2 wherein each of said first needle and said second needle is a hollow, slotted needle.

10. The self-contained button attachment assembly as claimed in claim 9 wherein said fastener dispensing tool further comprises (i) a needle carrier plate disposed within said housing, said first and second needles being fixedly mounted on said needle carrier plate and extending downwardly therefrom, (ii) a pusher plate positioned over said needle carrier plate, said pusher plate being slidable downwardly towards said needle carrier plate, and (iii) first and second ejector rods fixedly mounted on said pusher plate and extending downwardly therefrom, said first ejector rod being movably inserted into said first needle to dispense said first transverse foot of said first plastic fastener therefrom, said second ejector rod being movably inserted into said second needle to dispense said second transverse foot of said first plastic fastener therefrom.

11. The self-contained button attachment assembly as claimed in claim 9 wherein said housing is an elongated, hollow member having an open top and an open bottom and wherein said fastener dispensing tool further comprises (i) a needle carrier plate fixedly mounted within said housing, said first and second needles being fixedly mounted on said needle carrier plate and extending downwardly therefrom, (ii) a pusher plate positioned in said housing over said needle carrier plate and being actuable from the open top of said housing, said pusher plate being slidable downwardly towards said needle carrier plate, and (iii) first and second ejector rods fixedly mounted on said pusher plate and extending downwardly therefrom, said first ejector rod being movably inserted into said first needle to dispense said first transverse foot of said first plastic fastener therefrom, said second ejector rod being movably inserted into said second needle to dispense said second transverse foot of said first plastic fastener therefrom.

* * * * *